United States Patent [19]

Labonia

[11] 4,269,135

[45] May 26, 1981

[54] HYDROPLANES

[76] Inventor: Michelino Labonia, 44a Grosvenor Crescent, Summer Hill, New South Wales, Australia, 2130

[21] Appl. No.: 959,570

[22] Filed: Nov. 13, 1978

[30] Foreign Application Priority Data

Nov. 14, 1977 [AU] Australia ..... PD2411

[51] Int. Cl.[3] ..... B63B 1/16

[52] U.S. Cl. ..... 114/272

[58] Field of Search ..... 114/57, 59, 271, 272, 114/273, 274, 291, 312–313, 330–334; 115/39, 73; 244/120; 440/68–70, 88, 89

[56] References Cited

U.S. PATENT DOCUMENTS

| | | | |
|---|---|---|---|
| 731,394 | 6/1903 | Terwilleger | 9/4 A |
| 1,780,998 | 11/1930 | Curioni | 114/59 |
| 2,387,219 | 10/1945 | Wallis | 244/120 |
| 2,431,061 | 11/1947 | Mayo | 9/4 R |
| 3,382,833 | 5/1968 | Wukowitz | 114/291 |
| 3,831,208 | 8/1974 | Smith | 9/1.5 |

FOREIGN PATENT DOCUMENTS

| | | | |
|---|---|---|---|
| 307738 | 5/1933 | Italy | 114/271 |

*Primary Examiner*—Trygve M. Blix
*Assistant Examiner*—Jesus D. Sotelo
*Attorney, Agent, or Firm*—Hopgood, Calimafde, Kalil, Blaustein & Lieberman

[57] ABSTRACT

A hydroplane boat hull of cylindrical-ellipsoidal form formed from sections each having internal flanges formed around the edges thereof, the abutting flanges of the sections being secured together to form the hull and at the same time the flanges forming internal ribs for the hull. The hull includes a keel including an engine supporting base having a step formed thereon, a step providing a planing surface for the hull. A pair of propellor housings are joined to the engine supporting base, they extend longitudinally thereof and each propellor housing has an opening located adjacent the step so that as the hull rises to a planing position on the step the propellors constantly engage the water.

8 Claims, 6 Drawing Figures

HYDROPLANES

This invention relates to boats and more particularly to hulls for those craft known as hydroplanes which are especially adapted for high speed travel.

In the construction and assembly of hydroplane hulls, the features of hull rigidity and hull stability are of primary importance because of the extreme strains placed upon a hull when the boat is travelling at very high speeds.

The object of the present invention is to provide a hydroplane hull construction which is so arranged that maximum strength and rigidity is attained for the hull whilst lightness of weight is also retained as a basic feature of the hull. Also the hull is streamlined to reduce drag and to improve lift as the boat accelerates in use.

According to the invention, the hull, which is adapted to support power means for driving the boat propellors, air intake and exhaust lines for the power means, fixed stabilizers, movable stabilizers, a tail control assembly, a cockpit and controls in the cockpit; is characterised in that the hull is of cylindrical-ellipsoidal form assembled from sections each having integral internal flanges formed around the edges thereof whereby abutting flanges of said sections are secured together to form the hull, and whereby said abutting flanges form internal ribs for the hull; the hull includes a keel including an engine supporting base having a step formed externally thereon and a pair of propellor housings joined to the base and extending longitudinally thereof, the step providing a planing surface for the hull and each said propellor housing including an opening located adjacent the step whereby as the hull rises to a planing position on the step the propellors constantly engage the water.

An embodiment of the invention will be described with reference to the annexed drawings, wherein.

Figure 1:
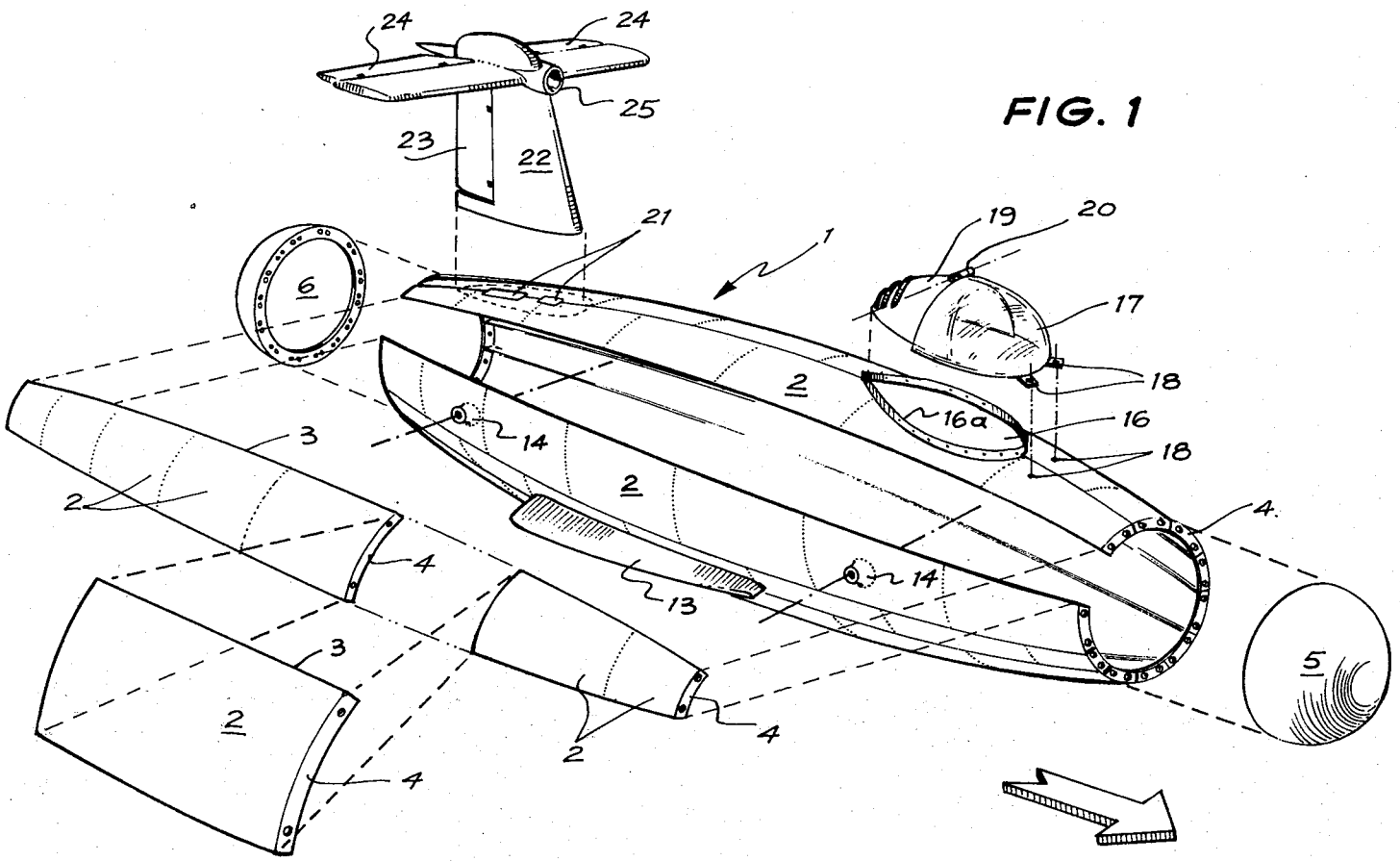
FIG. 1 is an exploded perspective view of the hull and some of the associated components, prior to final assembly.

The hull 1 is assembled from conjoined sections 2 to cylindrical-ellipsoidal form. The sections 2 are each preformed to desired curvature, length and width dimensions and have side flanges 3 and end flanges 4 formed integrally thereon. The section 2 forming the nose cone 5 of the hull is secured to the hull by welding and the tail cone 6 is removably secured to the hull by bolts.

Figure 5:
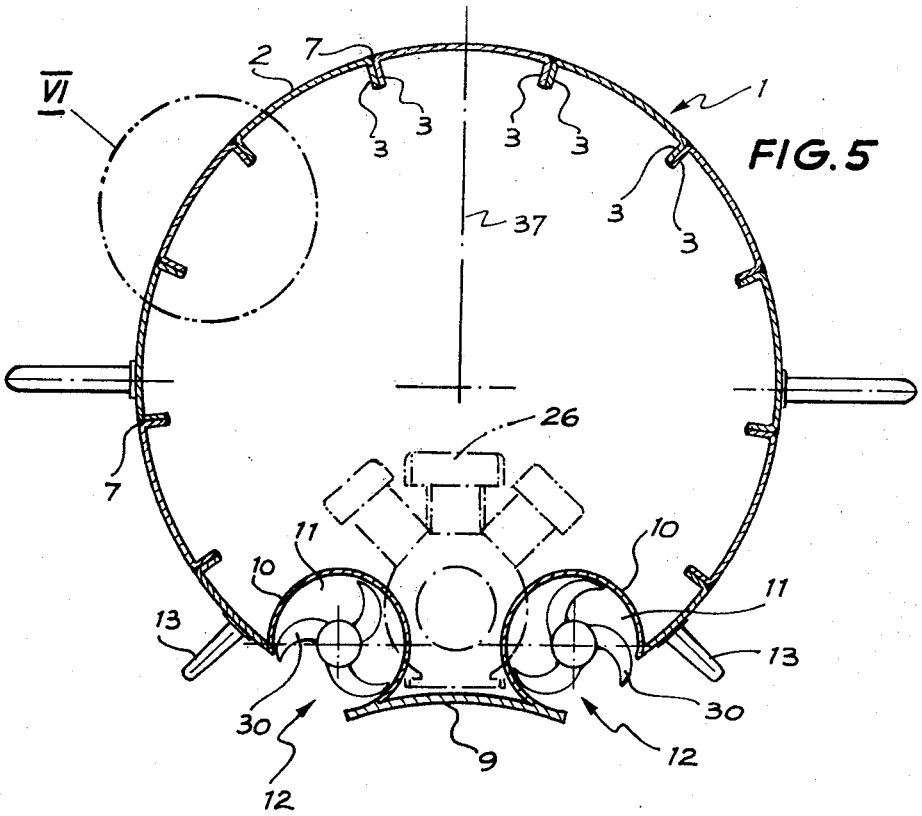
FIG. 5 is a transverse, somewhat diagrammatic sectional view of the hull on plan V—V of FIG. 2.
Figure 6:
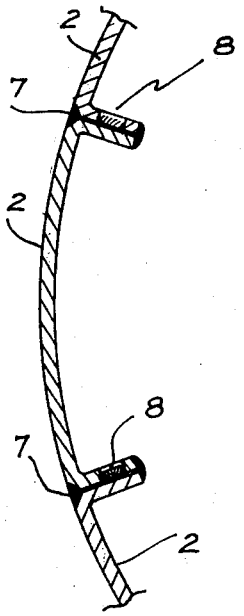
FIG. 6 is a detail view, on an enlarged scale, of the hull segments ringed by the circle VI in FIG. 5.

The sections are formed from stainless steel and they are welded together longitudinally and transversely as indicated at 7, FIGS. 5 and 6. Also, the flanges 3 are welded as indicated at 8, FIG. 6. The external welds 7 are formed flush with the exterior surface of the sections 2 and in the form of construction described, the conjoined, abutting flanges form internal ribs for the hull, longitudinally and circularly therein.

The hull bottom is formed in part by a keel indicated at 9, and two roll-formed segments 10 which are each shaped and arranged to be welded to adjacent sections 2 and to the keel 9, and each of which includes a propellor housing 11. Each propellor housing 10 is open longitudinally as indicated at 12. The keel 9 forms a step **9*a* where it is joined to the section 10**, for reasons to be explained.

Adjacent each propellor housing 11 and slightly above the upper edge of each opening 12, a fixed stabilizer 13 is mounted and secured along the hull 1. These stabilizers 13 are tapered from front to rear and are dimensioned as desired. They are of the general configuration shown in FIG. 2, they preferably curve outwardly downwardly away from the hull and serve to stabilize rolling of the hull.

Bearing mountings 14 are formed in four of the segments 2, fore and aft of the fixed stabilizers 13 and above said fixed stabilizers 13, for supporting movable stabilizers 15 which are adapted and arranged to be selectively, variably moved to stabilize pitching or rolling of the hull 1.

Adjacent the nose cone 5, selected ones of the sections 2 are formed to provide a cockpit opening 16 with a peripheral upstanding flange **16*a* over which a suitable cowling 17 is adapted to be secured as indicated at 18. The cowling 17 hingeably supports an upwardly opening part 19 which as illustrated, hinges upwardly as at 20** to an open position.

Adjacent the tail cone 6, selected ones of the sections 2 have openings 21 formed therethrough and a tail control assembly 22 is fixed to these segments 2 over said openings 21. The tail control assembly 22 includes a rudder 23, trim flats 24 and an air intake member 25.

The hull 1 also supports power means indicated as a motor 26; an air intake line 27 connected to the intake member 25 and to the intake manifold (not shown) of motor 26; exhaust line 28 connected through a muffler 29 through the hull 1 to atmosphere; propellors 30 mounted on propellor shafts 31, said propellors being located and housed one each in a propellor housing 11; conventional control means (not shown) are provided for the stabilizers 15.

The motor 26 does not, per se, form part of this invention and it is selected as desired. The keel 9 provides a base support for the motor 26 within the hull 1. The air intake line 27 is connected to the motor 26 through a filter and drain assembly indicated at 34 whereby air passing into the intake 25 is filtered and water is drained therefrom, prior to entering the intake line 27. As seen particularly in FIG. 2, water drains by gravity from the assembly 34 and out through the tail plane 22, as indicated at 35.

The exhaust, on the outlet ends of the muffler 29, is divided into four outlet lines 32, 33, two of which extend through the upper part of the hull 1 one on each side of the tail control 22 and two of which extend through the lower part of hull 1 one on each side of the keel 9 aft of the propellor housings 11. The exhaust lines 32, 33 are each covered by a flap valve 36 whereby, as the boat is driven ahead or astern, the appropriate pair of flap valves close.

The propellors 30 are diameter dimensioned whereby the blades have minimum clearance in the propellor housings 11 and project outwardly through the opening 12 in said housing 11. They are contra-rotating propellors and they are separated transversely by the keel 9. At speed, the boat will plane on the after end of the keel 9, i.e. on the step 9*a* and the propellor blades will constantly engage the water through said openings 12.

The control means for the stabilizers 15 may for example, be electronic or hydraulic. These control means may function continuously to maintain constant positional variation of said stabilizers 15 particularly when the boat is travelling at high speed or in choppy water.

Figure 2:
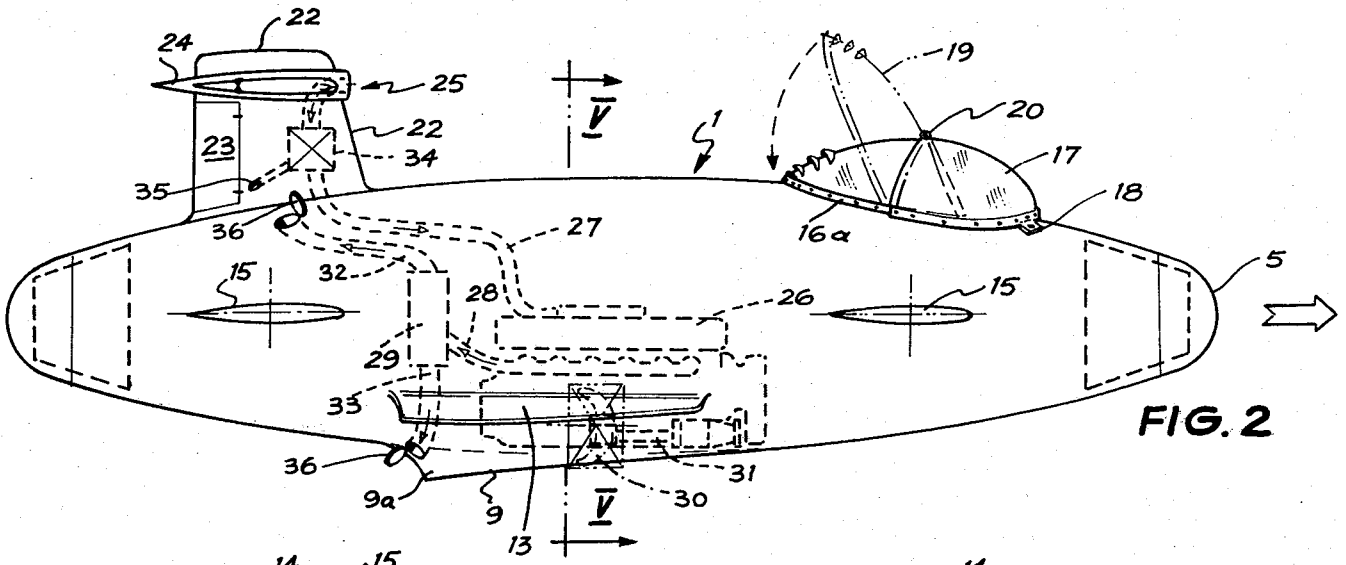
FIG. 2 is an side elevational view of the hull, showing in broken line, the disposition and location therein of the power means and propellors and other operating components.
Figure 3:
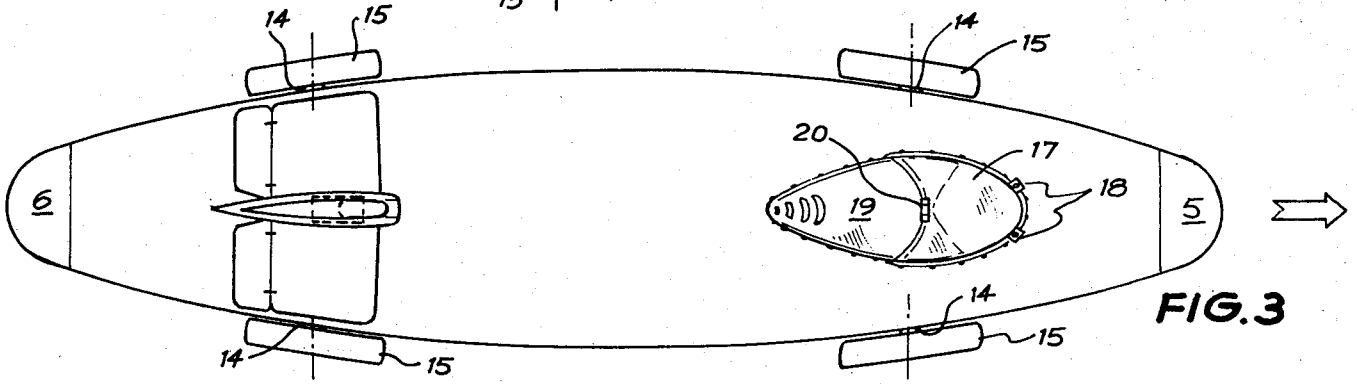
FIG. 3 is a plan view according to FIG. 2.
Figure 4:
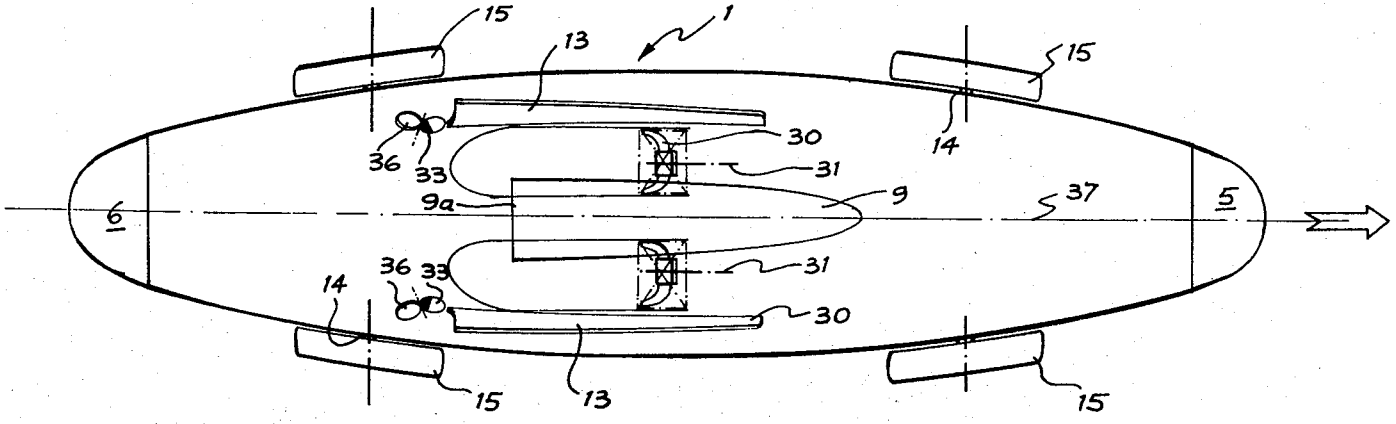
FIG. 4 is an inverted plan view according to FIG. 2.

The hull is formed, in the illustrated embodiment, with a length to maximum diameter ratio in the order of four to one. Also, it is preferred that the thickness of the sections forming the hull varies from the keel 9 to the vertical centre line 37 of the upper portion of the hull. In other words the thickness of each section forming the circumference of the hull progressively decreases from a maximum adjacent the keel to a minimum adjacent the centre line 37. The flanges of each section are however of constant thickness. This is achieved by welding or otherwise securing flutes to the flanges as is well understood in the art. As indicated in FIG. 2 the keel 9 is inclined at an angle of approximately 4° from bow to stern. This angle of inclination will however vary depending on the purpose for which the hull is designed.

Also, as seen particularly in FIG. 2, the vertical centre line of the forward stabilizer 15 is also the vertical centre line of the cowling 17; the vertical centre line of the after stabilizer 15 is also the vertical centre line of the tail control 22, the keel 9 and motor 26 are mounted centrally, both longitudinally and transversely, in and on the hull 1.

It will be understood that various modifications may be made to the hull, including the components supported thereby, without departing from the spirit and scope of the invention.

I claim:

1. A hydroplane boat hull adapted to support power means for driving the boat propellors, air intake and exhaust lines for the power means, fixed stabilizers, movable stabilizers, a tail control assembly, a cockpit and controls in the cockpit; characterised in that the hull is of cylindrical-ellipsoidal form assembled from fitted sections each having internal flanges integrally formed around the edges thereof with abutting flanges of said sections secured together by external welding to form the hull, whereby said abutting flanges form internal ribs for the hull; the hull includes a keel including an engine supporting base having a step formed externally thereon and a pair of propellor housings joined to the base and extending longitudinally thereof, the step providing a planing surface for the hull and each said propellor housing including an opening located adjacent the step whereby as the hull rises to a planing position on the step the propellors constantly engage the water.

2. A hydroplane boat hull according to claim 1, wherein the ratio of the hull length to its major diameter is of the order of four to one and the thickness of the sections forming the hull progressively decreases from a maximum adjacent the keel to a minimum adjacent the centre line of the upper portion of the hull.

3. A hydroplane boat hull according to claim 1, wherein the assembled sections are open at each end; a nose cone is secured in one end and a tail cone is secured in the other end.

4. A hydroplane boat hull according to claim 1, wherein the tail control assembly includes an air intake communicating through a drain and filter assembly with the power means; the drain and filter assembly includes a drain line communicating through the tail control assembly with atmosphere; and the power means includes an exhaust system having outlets communicating with atmosphere through the hull and respectively located adjacent and aft of the step and propellor housing, and adjacent the tail control assembly.

5. A hydroplane boat hull according to claim 1, wherein the fixed stabilizers are two in number each being located adjacent and above a said propellor housing opening.

6. A hydroplane boat hull according to claim 1, wherein the movable stabilizers are four in number located for rotational movement on the hull; said movable stabilizers being mounted in horizontally aligned pairs on a horizontal plane lying along the longitudinal centre of the hull, and being mounted in oppositely disposed pairs on vertical centre lines passing respectively through the tail control assembly and the cockpit.

7. A hydroplane boat hull according to claim 1, wherein the hull hingeably supports a cockpit cowling over a cockpit opening formed in adjacent ones of the assembled sections.

8. In a hydroplane boat hull adapted to support power means for driving water-engaging propellors, air intake and exhaust lines for the power means, fixed stabilizers, movable stabilizers, and a tail control assembly, the improvement in which the hull is of cylindrical-ellipsoidal form assembled from mutually secured edge-to-edge abutted hull sections each of which sections has integrally formed inwardly directed flanges around the edges thereof, adjacent flanges being in abutment whereby abutting flanges of adjacent sections form internal ribs for the hull, said hull including a keel having an engine supporting base with a step formed externally thereon and a pair of propellor housings joined to the base on opposite lateral sides of said step and extending longitudinally thereof, the step providing a planing surface for the hull and each said propellor housing being downwardly open adjacent the step whereby as the hull rises to a planing position on the step the propellors constantly engage the water.

* * * * *